US007469435B1

(12) United States Patent
Cullifer

(10) Patent No.: US 7,469,435 B1
(45) Date of Patent: Dec. 30, 2008

(54) PILLOW ADAPTED TO RECEIVE SOUND

(76) Inventor: Bryan C. Cullifer, 735 Maury Ave., Norfolk, VA (US) 23517

( * ) Notice: Subject to any disclaimer, the term of this patent is extended or adjusted under 35 U.S.C. 154(b) by 0 days.

(21) Appl. No.: 12/017,000

(22) Filed: Jan. 19, 2008

(51) Int. Cl.
*A47G 9/00* (2006.01)

(52) U.S. Cl. ..... 5/636; 5/638

(58) Field of Classification Search ..... 5/636, 5/638, 639, 643, 644, 645; D6/601
See application file for complete search history.

(56) References Cited

U.S. PATENT DOCUMENTS

| | | | | | |
|---|---|---|---|---|---|
| 2,199,479 | A | * | 5/1940 | Cappel | 5/637 |
| 2,336,707 | A | | 12/1943 | Thompson | |
| 3,009,172 | A | | 11/1961 | Eidam | |
| 3,347,544 | A | * | 10/1967 | Uffenorde | 5/637 |
| D214,302 | S | * | 6/1969 | Barber | D6/601 |
| 3,667,074 | A | | 6/1972 | Emery | |
| 3,949,437 | A | | 4/1976 | Gritsch | |
| 4,440,443 | A | | 4/1984 | Nordskog | |
| 4,513,462 | A | | 4/1985 | Thomas | |
| D308,787 | S | | 6/1990 | Youngblood | |
| D316,353 | S | | 4/1991 | Dobson | |
| D318,923 | S | | 8/1991 | Marsh | |
| D414,974 | S | * | 10/1999 | Marrone et al. | D6/601 |
| 5,970,546 | A | * | 10/1999 | Danis | 5/636 |
| D420,845 | S | * | 2/2000 | Rumage | D6/601 |
| 6,026,330 | A | | 2/2000 | Chuan | |
| 6,622,325 | B1 | * | 9/2003 | Garza | 5/636 |

* cited by examiner

*Primary Examiner*—Alexander Grosz

(57) ABSTRACT

A pillow that has a channel which extends from one end toward a second end and which has a wall defined from a head-supporting surface of the pillow toward a bottom of the pillow. The wall of the channel is located adjacent to the second end of the pillow. The channel allows sound to reach a user's ear that is located in the channel while the user lies his or her head on the pillow.

1 Claim, 2 Drawing Sheets

PILLOW ADAPTED TO RECEIVE SOUND

TECHNICAL FIELD OF THE INVENTION

The present invention relates to the general art of support devices, and to the particular field of pillows.

BACKGROUND OF THE INVENTION

Standard solid-bodied pillows in common use for many years have a number of limitations. The downward force caused by the weight of a person's head on tissue and facial skin in contact with solid bodied pillows is considerable, causing local stretching and deformation of the skin. Over a period of many years this deformation accelerates wrinkling of the skin, contributing to the visible effects of ageing.

Similarly, the outer surfaces of the ears are crushed by the weight of the head when a person using a pillow lies to the side, contributing to the incidence of bacterial and fungal ear infections, morning wax deafness, ear ache and gradual deformation and wrinkling of the pinna.

Still further, a major problem for people who are wish to hear while lying with one ear on a pillow, such as when they are watching television, occurs because the otherwise properly functioning ear is in contact with the pillow. Due to the seal the ear makes with the pillow or pillowcase, air is not able to carry sound waves to that ear. In this position, the person has difficulty hearing because one ear is not exposed to sound waves.

There are numerous circumstances where lack of hearing while lying down can inconvenience the person or cause serious and dangerous problems. Oftentimes, for example, only one side of the head is placed on a pillow while watching television or listening to music from a bed or a couch. This situation requires the hard of hearing individual to sacrifice either comfort, or the ability to hear the television program or musical piece.

Therefore, there is need for a pillow that can support a user's head while the user has his or her ear on the pillow in a manner which allows sound to easily reach the ear on the pillow-contacting side of the user's head.

While the inventor is aware of pillows that are designed to support a user's head while that user wears curlers or that will accommodate a user's face while the user lies face-down on the pillow, the inventor is not aware of any pillow that will acoustically connect a user's ear to the area surrounding the pillow via a large opening in the pillow whereby sounds can easily reach the pillow-adjacent ear of the user.

SUMMARY OF THE INVENTION

The above-discussed disadvantages of the prior art are overcome by a wedge-shaped foam pillow that has a channel which extends from one end toward a second end and which has a wall defined from a head-supporting surface of the pillow toward a bottom of the pillow. The wall of the channel is located adjacent to the second end of the pillow and the other end of the channel is open to the area surrounding the pillow via the first end of the pillow. The channel allows sound to reach a user's ear that is located in the channel while the user lies his or her head on the pillow. The channel opens to the surrounding area via the opening in the end of the pillow. This opening will be large and will generally be unobstructed so sound can easily and efficiently pass into the channel whereby the acoustic coupling between the user's ear and the area surrounding the pillow is efficient and can be as large as desired to ensure excellent acoustic coupling between the user's ear and the area surrounding the pillow.

Other systems, methods, features, and advantages of the invention will be, or will become, apparent to one with skill in the art upon examination of the following figures and detailed description. It is intended that all such additional systems, methods, features, and advantages be included within this description, be within the scope of the invention, and be protected by the following claims.

BRIEF DESCRIPTION OF THE DRAWING FIGURES

The invention can be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE INVENTION

Figure 1:
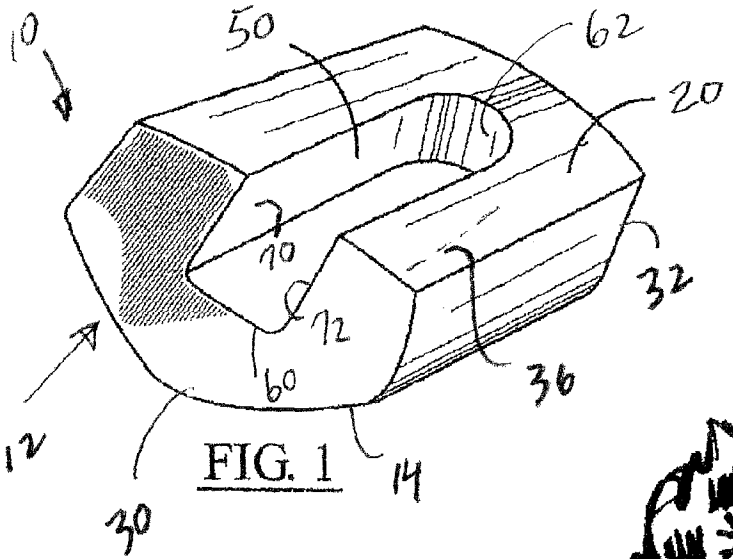
FIG. 1 is a side and top perspective view of a pillow embodying the present invention.
Figure 2:
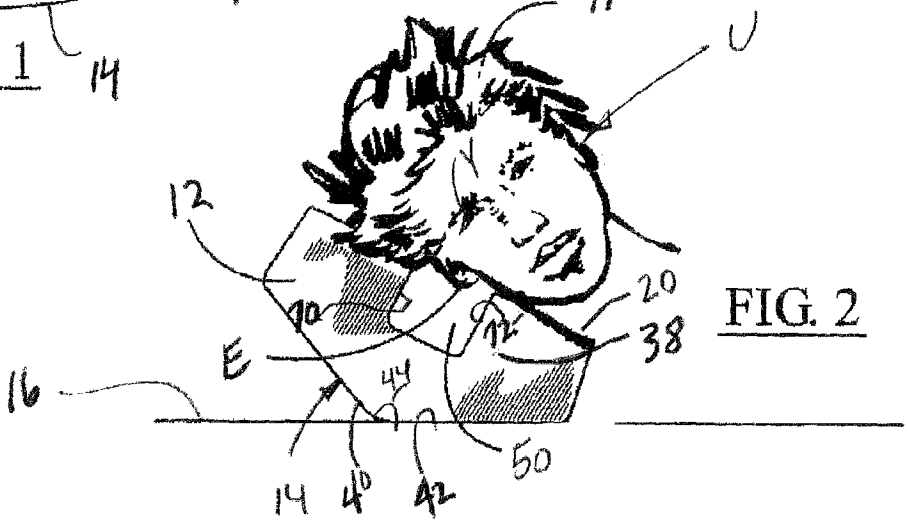
FIG. 2 is a side elevational view of the pillow in use.

Referring to the figures, it can be understood that the present invention is embodied in a pillow 10 that will allow a person using the pillow to hear sounds umuffled by the pillow even though they have the side of their head on the pillow. Pillow 10 comprises a body 12 which is formed of foam or like material. Body 12 includes a first surface 14 that is a bottom surface when the body is in use and which contacts a supporting surface 16 when the body is in use such as shown in FIG. 2. Body 12 further includes a second surface 20 that is a top surface when the body is in use and which contacts a user when the body is in use. Body 12 further includes a first end 30 which connects the first surface to the second surface, a second end 32 which also connects the first surface to the second surface, a longitudinal axis 36 which extends between the first end and the second end and a thickness dimension 38 which extends between the first surface and the second surface. As can be understood from the disclosure of FIG. 2, first surface 14 of the body includes a first portion 40 and a second portion 42. The first and second portions intersect to define an oblique angle 44 whereby the body has a pentagonal, or wedge-shaped, cross sectional shape.

A blind-ended groove 50 is defined in the body through second surface 20 and extends from first end 30 of the body toward second end 32 in the direction of longitudinal axis 36. Groove 50 intersects first end 30 of the body. Groove 50 includes an opening 60 defined in first end 30 at the intersection of the groove and the first end. An end wall 62 is located adjacent to second end 32. End wall 62 is spaced apart from second end 32 in the direction of longitudinal axis 36 and extends in the direction of thickness dimension 38 of the body.

A first side wall 70 of groove 50 extends from second surface 20 of the body toward first surface 14 of the body in the direction of thickness dimension 38 of the body and which connects end wall 62 to opening 60 defined in first end 30 of the body. Groove 50 further includes a second side wall 72 which extends from second surface 20 of the body toward first surface 14 body in the direction of the thickness dimension of the body. Second side wall 72 connects end wall 62 of the groove to opening 60 defined in the first end of the body. Second side wall 72 of the groove is parallel to first side wall 70 of the groove.

Groove 50 defines a sound channel which extends from the first end wall of the body and is acoustically connected to an ear E of a user U when the user lies their head H on the body with their ear in the groove as shown in FIG. 2. It is also noted that some prior art pillows will allow the user's head to sink into the pillow thereby obstructing the view from eye Y. However, eye Y will have an unobstructed view through groove 50 with pillow 10.

Figures 3, 4:
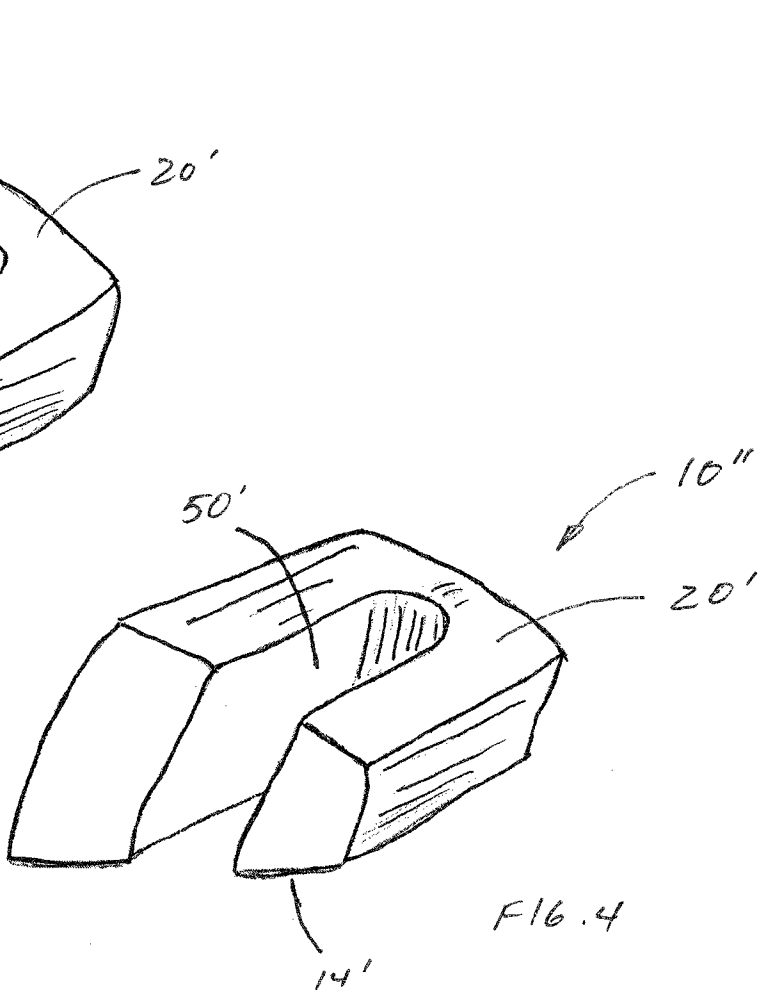
FIG. 3 is a perspective view of another embodiment of the present invention.
FIG. 4 is a perspective view of yet another embodiment of the present invention.

FIG. 3 shows a pillow 10' where the first surface 14' is substantially flat so that the second surface 20' is at a predetermined angle relative to the supporting surface 16. FIG. 4 shows the pillow 10" having a groove 50' forming a complete opening between the first surface 14' and the second surface 20' such that the pillow 10" forms a "U" shape pillow.

While various embodiments of the invention have been described, it will be apparent to those of ordinary skill in the art that many more embodiments and implementations are possible within the scope of this invention. Accordingly, the invention is not to be restricted except in light of the attached claims and their equivalents.

What is claimed is:

1. A pillow comprising:

A) a body which includes (1) a first surface that is a bottom surface when the body is in use and which contacts a supporting surface when the body is in use, (2) a second surface that is a top surface when the body is in use and which contacts a user when the body is in use, comprised of a first portion and a second portion, with the first and second portions intersecting to define an oblique angle, whereby the body has a pentagonal cross sectional shape, (3) a first end which connects the first surface to the second surface, (4) a second end which connects the first surface to the second surface, (5) a longitudinal axis which extends between the first end and the second end, and (6) a thickness dimension which extends between the first surface and the second surface;

B) a blind-ended groove defined in the body through the second surface and which extends from the first end of the body toward the second end in the direction of the longitudinal axis, the groove intersecting the first end of the body and including (1) an opening defined in the first end at the intersection of the groove and the first end, (2) an end wall located adjacent to the second end, the end wall being spaced apart from the second end in the direction of the longitudinal axis and extending in the direction of the thickness dimension of the body, (3) a first side wall which extends from the second surface of the body toward the first surface of the body in the direction of the thickness dimension of the body and which connects the end wall to the opening defined in the first end of the body, and (4) a second side wall which extends from the second surface of the body toward the first surface body in the direction of the thickness dimension of the body and which connects the end wall of the groove to the opening defined in the first end of the body, the second side wall of the groove being parallel to the first side wall of the groove; and C) the groove defining a sound channel which extends from the first end wall of the body and will be acoustically connected to an ear of a user when the user lies their head on the body with the ear in the groove.

* * * * *